US010920450B2

(12) United States Patent
Horiuchi

(10) Patent No.: US 10,920,450 B2
(45) Date of Patent: Feb. 16, 2021

(54) LOCKING STRUCTURE FOR COVER COVERING HANDLE SEAT

(71) Applicant: Kuriki Manufacture Co., LTD, Tokyo (JP)

(72) Inventor: Mitsuru Horiuchi, Saitama-Ken (JP)

(73) Assignee: KURIKI MANUFACTURE CO., LTD.

( * ) Notice: Subject to any disclaimer, the term of this patent is extended or adjusted under 35 U.S.C. 154(b) by 124 days.

(21) Appl. No.: 16/094,463

(22) PCT Filed: Apr. 18, 2016

(86) PCT No.: PCT/JP2016/002076

§ 371 (c)(1),
(2) Date: Mar. 25, 2019

(87) PCT Pub. No.: WO2017/183056

PCT Pub. Date: Oct. 26, 2017

(65) Prior Publication Data

US 2019/0211580 A1 Jul. 11, 2019

(51) Int. Cl.
*E05B 3/06* (2006.01)
*E05B 15/02* (2006.01)
(Continued)

(52) U.S. Cl.
CPC ..... *E05B 3/065* (2013.01); *E05B 3/06* (2013.01); *E05B 15/0205* (2013.01);
(Continued)

(58) Field of Classification Search
CPC . Y10T 292/82; Y10T 292/85; Y10T 292/854; Y10T 292/865; Y10T 292/869;
(Continued)

(56) References Cited

U.S. PATENT DOCUMENTS 48,024 A * 5/1865 Nobles ..... E05B 3/06 292/348
88,918 A * 4/1869 Sloan ..... E05B 1/0007 292/347
(Continued)

FOREIGN PATENT DOCUMENTS

DE 102006006957 A1 * 8/2007 ..... E05B 15/02
DE 202011000933 U1 * 8/2011 ..... E05B 3/06
(Continued)

OTHER PUBLICATIONS

English abstract for JP-2010-37841.
English abstract for JP-3162783.
English abstract for JP-2012120796.

*Primary Examiner* — Carlos Lugo
(74) *Attorney, Agent, or Firm* — Fishman Stewart PLLC

(57) ABSTRACT

A locking structure for a cover covering a handle seat may include a cover placed to cover a disk-shaped handle seat mounted on a surface of a door and may include a cover locking mechanism, a handle seat-side locking portion, and a rotation prevention mechanism. The cover locking mechanism may include a plurality of protrusion-shaped cover-side locking portions protruding inward at circumferential intervals at an opening end edge of the cover. The handle seat-side locking portion may include a groove portion and a hooking groove portion to which the cover is hooked when the cover-side locking portion is inserted when the cover placed is rotated. The rotation prevention mechanism may include a biased latch arranged at the groove portion. The latch may have an engagement portion projecting and retracting with respect to a bottom surface of the groove portion.

4 Claims, 3 Drawing Sheets

(51) Int. Cl.
*E05B 63/04* (2006.01)
*E05B 15/04* (2006.01)

(52) U.S. Cl.
CPC ..... *E05B 63/042* (2013.01); *E05B 15/04* (2013.01); *E05B 2015/0403* (2013.01); *Y10T 292/82* (2015.04); *Y10T 292/85* (2015.04); *Y10T 292/91* (2015.04)

(58) Field of Classification Search
CPC ..... Y10T 292/873; Y10T 292/876; Y10T 292/88; Y10T 292/91; E05B 3/06
USPC ..... 285/361, 396, 402; 403/349; 70/224, 70/448, 449, 451
See application file for complete search history.

(56) References Cited

U.S. PATENT DOCUMENTS 88,919 A * 4/1869 Sloan ..... E05B 1/0007 292/347
538,952 A * 5/1895 Donovan ..... E05B 1/0007 292/347
981,866 A * 1/1911 Lockhart ..... F16L 37/252 285/87
1,164,197 A * 12/1915 Kildear ..... E05B 35/008 70/161
1,519,500 A * 12/1924 Miller ..... G05G 1/12 292/356
1,519,503 A * 12/1924 Norwood ..... G05G 1/12 292/356
1,556,716 A * 10/1925 Robichaud ..... E05B 3/06 292/348
1,799,253 A * 4/1931 Rogers ..... E05B 3/06 292/350
2,423,206 A * 7/1947 Schlage ..... E05B 15/02 292/357
3,044,817 A * 7/1962 Marcante ..... E05B 3/003 292/336.3
4,869,083 A * 9/1989 DeMarseilles ..... E05B 55/005 70/224
4,917,525 A * 4/1990 Duncan ..... H01R 13/625 285/93
4,976,480 A * 12/1990 Dixon ..... E05B 55/005 292/353
5,149,155 A * 9/1992 Caeti ..... E05B 55/005 292/336.3
5,333,915 A * 8/1994 Sparling ..... F16L 37/252 285/69
5,857,713 A * 1/1999 Horimoto ..... F16L 37/252 285/114
5,960,517 A * 10/1999 Sprekeler ..... E05B 3/065 292/336.3
6,048,007 A * 4/2000 Shor ..... E05B 3/065 292/336.3
6,223,572 B1 * 5/2001 Marttinen ..... E05B 9/002 292/348
7,243,953 B2 * 7/2007 Nakamura ..... F16L 37/248 285/360
8,172,284 B2 * 5/2012 Chern ..... E05B 3/06 292/336.3
8,235,431 B2 * 8/2012 Williamson ..... E05B 1/003 292/348
2006/0208487 A1 * 9/2006 Ambrosi ..... F16L 37/252 285/396
2010/0001438 A1 1/2010 Kishimoto

FOREIGN PATENT DOCUMENTS

EP 2182144 A1 * 5/2010 ..... E05B 3/065
EP 2840203 B1 * 2/2016 ..... E05B 3/065
FR 2696778 * 4/1994
JP 3096257 U 9/2003
JP 39-18179 B1 5/2007
JP 2010-37841 A 2/2010
JP 3162783 U 9/2010
JP 2012120796 A 6/2012

* cited by examiner

LOCKING STRUCTURE FOR COVER COVERING HANDLE SEAT

CROSS-REFERENCE TO RELATED APPLICATIONS

This application claims priority to International Patent Application No. PCT/JP2016/002076, filed on Apr. 18, 2016, the contents of which are hereby incorporated by reference in its entirety.

TECHNICAL FIELD

The present invention relates to a locking structure for a cover covering a disk-shaped handle seat mounted on an inner side surface and an outer side surface of a door for supporting a square core provided with a handle, e.g., a lever handle or a door knob, at an end for actuating a latch lock attached to the door.

BACKGROUND

Conventionally, a disk-shaped handle seat mounted on an inner side surface and an outer side surface of a door for supporting a square core provided at an end with a handle, e.g., a lever handle or a door knob, for actuating a latch lock attached to the door is used. This handle seat is often fixed to a lock main body attached to a door by a bolt or the like. Therefore, such a bolt is exposed on the surface, and moreover a hub or the like for holding the square core to which the handle is fixed is also exposed. Therefore, after the door is attached, a cover is placed to cover the front surface and the outer circumferential surface to improve the external aesthetic appearance. In particular, recently, a cover has been one of the very important components. For example, a cover and a handle are designed to be integrated to fit to a door or the like.

Incidentally, needless to say, the cover for covering the handle seat requires easy attachment and easy removal for repair or replacement of a lock or the like. In addition, for example, beauty of aesthetic appearance is required as described above. Therefore, as presented, for example, in JP Utility Model Registration No. 3096257 and JP2002-120796 A, generally, an engagement protrusion is used for fixation such that, for example, a protrusion provided on the inner side surface of the cover is locked to a recess or a step portion provided on the outer surface of the handle seat or a protrusion provided on the cover is engaged on an annular step portion provided on a rear surface edge of the handle seat.

Furthermore, such covers are often rotated in the circumferential direction with the covers once being placed in a predetermined circumferential position of the handle seat to engage the protrusion on the recess or the step portion of the handle seat, and is rotated in the opposite direction to cancel the engagement such that, as described above, engagement is easily made during attachment and is easily canceled during repair or replacement. In addition, because a tool is not used for forcible cancellation for removal, there is no concern that deformation or damage occurs during attachment and detachment.

However, there is a problem that, because of the necessity of enabling easy engagement and disengagement as described above, a locked state is loosely formed, resulting in rotation of the cover in use followed by removal of the cover. In particular, when the cover for covering the handle seat also serves to retain the handle, there is also a problem that the cover is likely to rotate when the handle is operated and the rotation causes the handle to be removed.

CITATION LIST

Patent Literature

Patent Literature 1: JP3096257 U
Patent Literature 2: JP2002-120796 A

SUMMARY

The present invention is made to overcome the aforementioned problems, and it is an object of the present invention to provide a locking structure for a cover covering a handle seat in which, needless to say, in the case of covering and in the case of removal as in the case of the conventional cover, a locking means between the handle seat and the cover is easily engaged and disengaged, and in the case of being placed, the locked state is reliably held and the cover is not removed.

The present invention made to overcome the aforementioned problems is a locking structure for a cover placed to cover a front surface and a circumferential surface of a disk-shaped handle seat mounted opposite an inner side surface and an outer side surface of a door for supporting a square core equipped with a handle for actuating a latch mechanism arranged within a door, the locking structure including: a cover locking means including a plurality of protrusion-shaped cover-side locking portion protruding inward at circumferential intervals at an opening end edge of the cover, and a handle seat-side locking portion formed of a groove portion extending from a front surface to a rear surface through which the cover-side locking portion formed on the cover can be inserted when the cover is placed and a hooking groove portion formed from the front surface to the rear surface of the handle seat continuously in a rotation direction of the groove portion, to which the cover is hooked when the cover-side locking portion formed on the cover is inserted when the cover placed is rotated; and a rotation prevention means including a latch arranged to be movable back and forth and biased in a direction of an end along an axis from a center to an outer circumferential surface of the handle seat at a position of the groove portion forming the handle seat-side locking portion and having, at an end, an engagement portion projecting and retracting with respect to a bottom surface of the groove portion such that, when the locking means is in a hooked state, the engagement portion is protruded to the groove portion and contacts the cover-side locking portion erected on the cover.

In addition, according to the present invention, when an inset hole for a tool for retracting the latch into the handle seat is formed in a position where an inner surface of a body portion of the cover contacts the latch, a rotation prevention state between the handle seat and the cover can very easily be canceled.

In particular, the latch formed on the handle seat is arranged to face downward and the inset hole for the tool is not exposed to the outer surface, which does not impair external aesthetic appearance.

Additionally, the present invention is particularly effective when the cover also serves to retain the handle.

According to the present invention, needless to say, the locking means between the handle seat and the cover can easily be engaged and disengaged in the case of covering and in the case of removal as in the case of the conventional cover, and the locked state is reliably held and the cover is not removed when placed, and in particular it is very effective when being used for a handle seat of a type in which the cover for covering the handle seat also serves to retain the handle, the cover being easily rotated when the handle is operated.

DETAILED DESCRIPTION

A preferred embodiment of the present invention is described below in detail with reference to the drawings.

Figure 1:
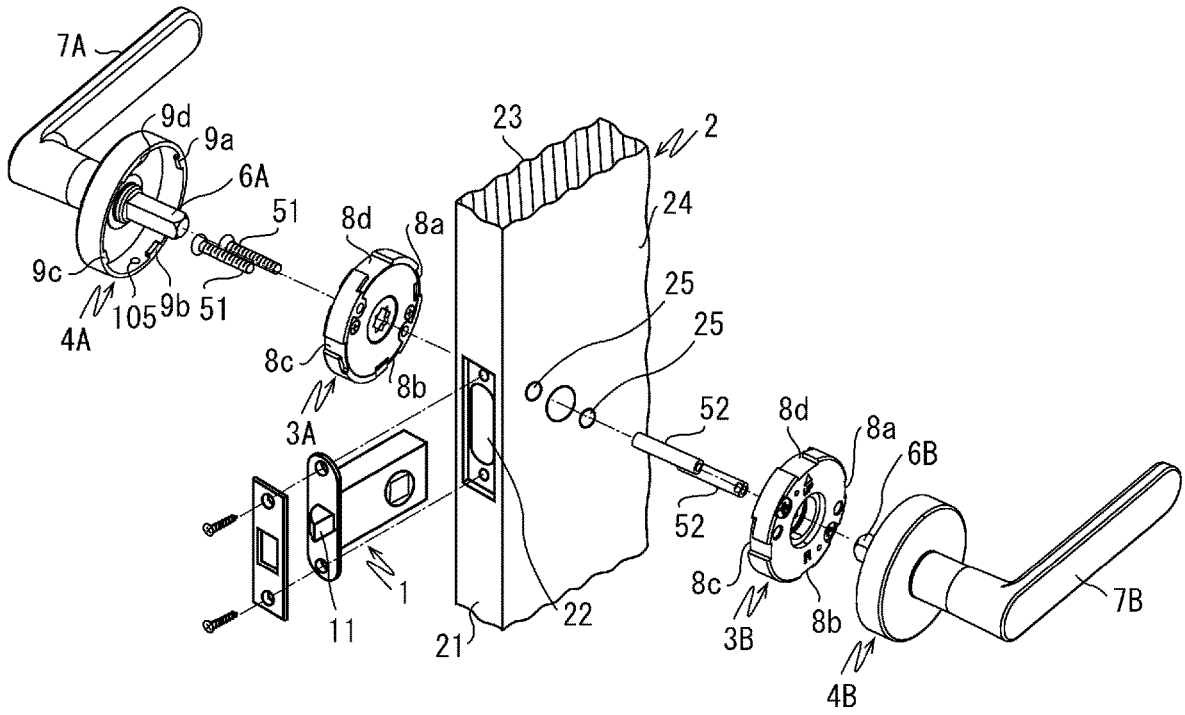
FIG. 1 is a schematic cross-sectional view indicating a preferred embodiment of the present invention.
Figure 2:
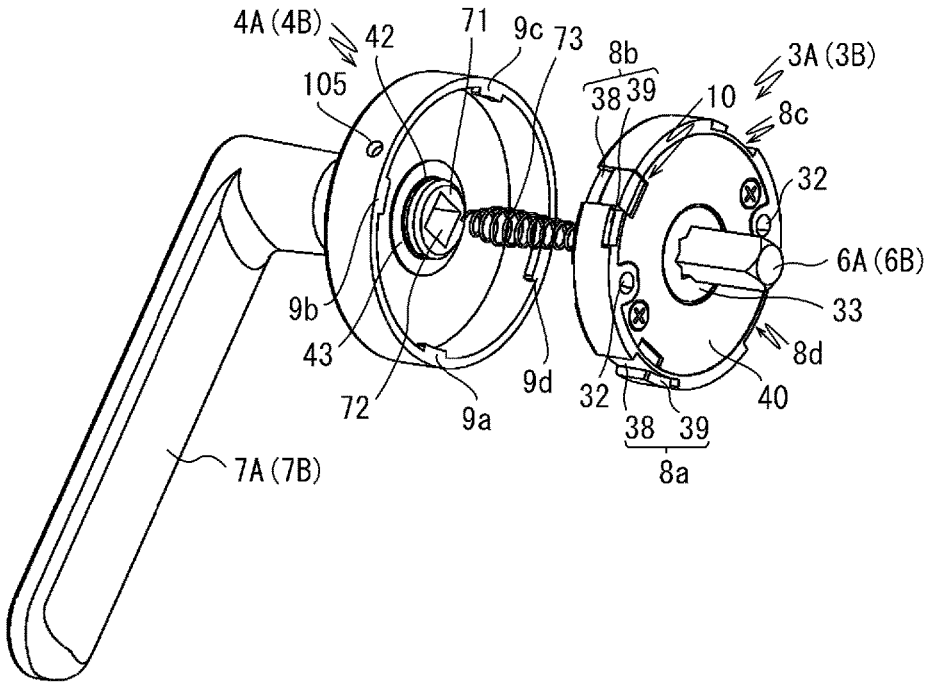
FIG. 2 is a perspective view viewed from a lower side of the embodiment illustrated in FIG. 1.
Figure 3:
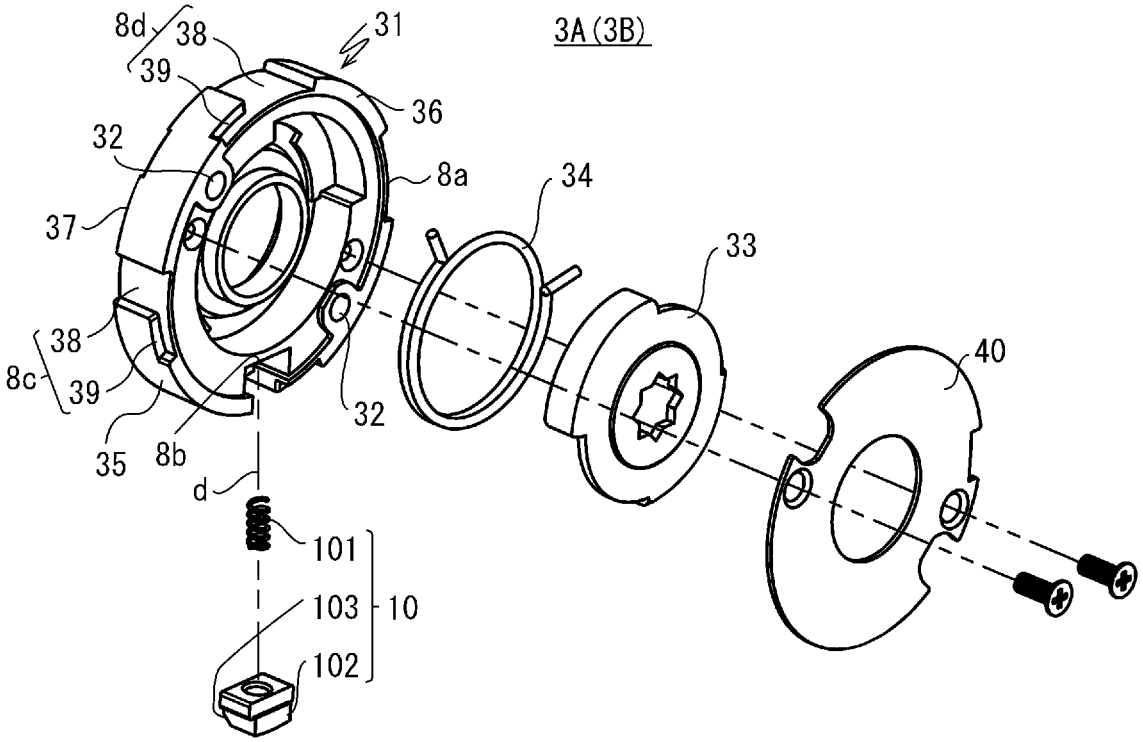
FIG. 3 is an exploded perspective view of a handle seat of the embodiment illustrated in FIG. 1.
Figure 4:
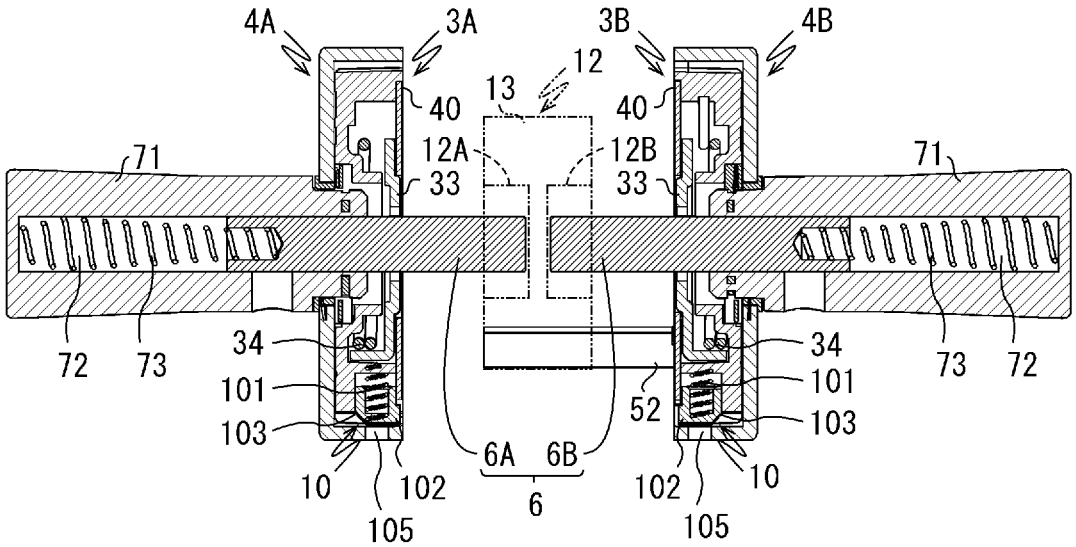
FIG. 4 is a transverse cross-sectional view of the embodiment illustrated in FIG. 1.

FIG. 1 is an exploded perspective view indicating a state in which, for example, a preferred embodiment of the present invention is used, for example, in a door 2 for indoors in which a latch mechanism 1, which is a box-shaped latch lock on which a latch bolt 11 is arranged to be projectable and retractable, is embedded in an attachment groove 22 formed on an edge 21. Handle seats 3A, 3B used in the present inventions are respectively arranged on an inner side surface 23 and an outer side surface 24 of the door 2 opposite each other and are mounted in the same manner as the conventional handle seat by bolts 51, 51 and threaded cylinders 52, 52 through through-holes 25, 25 formed through the door 2. Covers 4A, 4B having a thin, bottomed cylindrical shape having a U-shape in cross-section are placed on the handle seats 3A, 3B, respectively.

In particular, in the present embodiment, a square core 6 for actuating the latch mechanism 1 is formed of two halved square core members 6A, 6B. In addition, handles 7A, 7B having a lever shape equipped at ends of the square core members 6A, 6B are held. This configuration differs from a conventional type (not illustrated) in which handles are equipped at both ends of a single square core.

In greater details, the handle seats 3A (3B) of the present embodiment have a mutually symmetrical structure and have a bottomed cylindrical shape generally showing a thin shape, and accommodate a handle seat main body 31 formed with through-holes 32, 32 for the bolts 51, 51 (or the threaded cylinders 52, 52) illustrated in FIG. 1 for attachment to the door 2, and, in the handle seat main body 31, a hub 33 rotatably accommodated and formed, at a center, with an insertion hole for the square core members 6A (6B), and a return spring 34 for rotating the hub 33 in an actuation direction and a reverse direction.

On an outer circumferential surface 35 of the handle seat main body 31, at four points—upper and lower and right and left—orthogonal each other, four handle seat-side locking portions 8*a*, 8*b*, 8*c*, 8*d* having an arc-shaped grooves on which the cover 4A(4B) is hooked are formed opposite the cover-side locking portions 9*a*, 9*b*, 9*c*, 9*d*. The cover-side locking portions 9*a*, 9*b*, 9*c*, 9*d* having a protruding shape in which an end surface protruding inward at predetermined intervals in a circumferential direction at an opening end edge 41 of the cover 4A(4B) at four points—upper and lower and right and left orthogonal each other has an arch with a predetermined width is hooked.

Each handle seat-side locking portion 8*a*, 8*b*, 8*c*, 8*d* formed on the outer circumferential surface 35 of the handle seat 3A (3B) is formed of a groove portion 38 extending from a front surface 36 to a rear surface 37 through which each cover-side locking portion 9*a*, 9*b*, 9*c*, 9*d* formed on the cover 4A (4B) can be inserted when the cover 4A (4B) is placed on the handle seat 3A (3B), and a hooking groove portion 39 contiguously formed in a rotation direction of the groove portion 38 from the front surface 36 to the rear surface 37 of the handle seat and to which each cover-side locking portion 9*a*, 9*b*, 9*c*, 9*d* formed on the cover 4A (4B) is inserted when the placed cover is rotated so that the cover 4A (4B) is hooked. In the drawings, reference numeral 40 indicates a lid plate for covering an opening of the handle seat main body 31.

In addition, in the present embodiment, a rotation prevention means 10 formed of a latch arranged be movable back and forth along an axis d toward the outer circumferential surface 35 from a center in a position of the groove portion 38 forming the locking portion 8 formed on a lower side of the handle seat of the handle seat main body 31 and is biased in a direction of an end by a coil spring 101, and has, at an end, an engagement portion 102 for projecting and retracting with respect to a bottom surface of the groove portion 38 is arranged on the groove portion 38.

Furthermore, in the present embodiment, a shaft member 71 to which the handle 7A (7B) is fit at a proximal end is inserted through a through-hole 42 formed through the cover 4A(4B) and is rotatably and fixedly secured by a retainer ring 43, and a proximal end of the square core member 6A(6B) is non-rotatably inserted and supported via a coil spring 73 in a square hole 72 formed at an end of the shaft member 71.

In the present embodiment having the aforementioned configuration, the covers 4A(4B) equipped with the handles 7A(7B) and the square core members 6A(6B) are placed and hooked on the handle seat 3A(3B) arranged on the inner side surface 23 and the outer side surface 24 of the door 2 as illustrated in FIG. 1.

The present embodiment is used, for example, for a door of a hotel. The hub 12 of the latch mechanism 1 is divided in a hub casing 13 into two: an indoor hub member 12A to which the square core member 6A on the indoor side is inserted and an outdoor hub member 12B to which the square core member 6B on the outdoor side is inserted. The hub member 12A is rotatably arranged in the hub casing 13 as with a usual hub and is engaged on the latch bolt 11. The handle 7A having a lever shape equipped at an end of the square core 6A on the indoor side is rotated to project or retract the latch bolt 11 to perform locking and unlocking. Meanwhile, the hub member 12B is fixed to the hub casing 13. The handle 7B having a lever shape equipped at an end of the square core 6B on the outdoor side cannot be rotated. In this structure, unlocking cannot be made from the outdoor side.

Next, the operation of the present embodiment in use is described with reference to FIG. 5.

Figure 5:
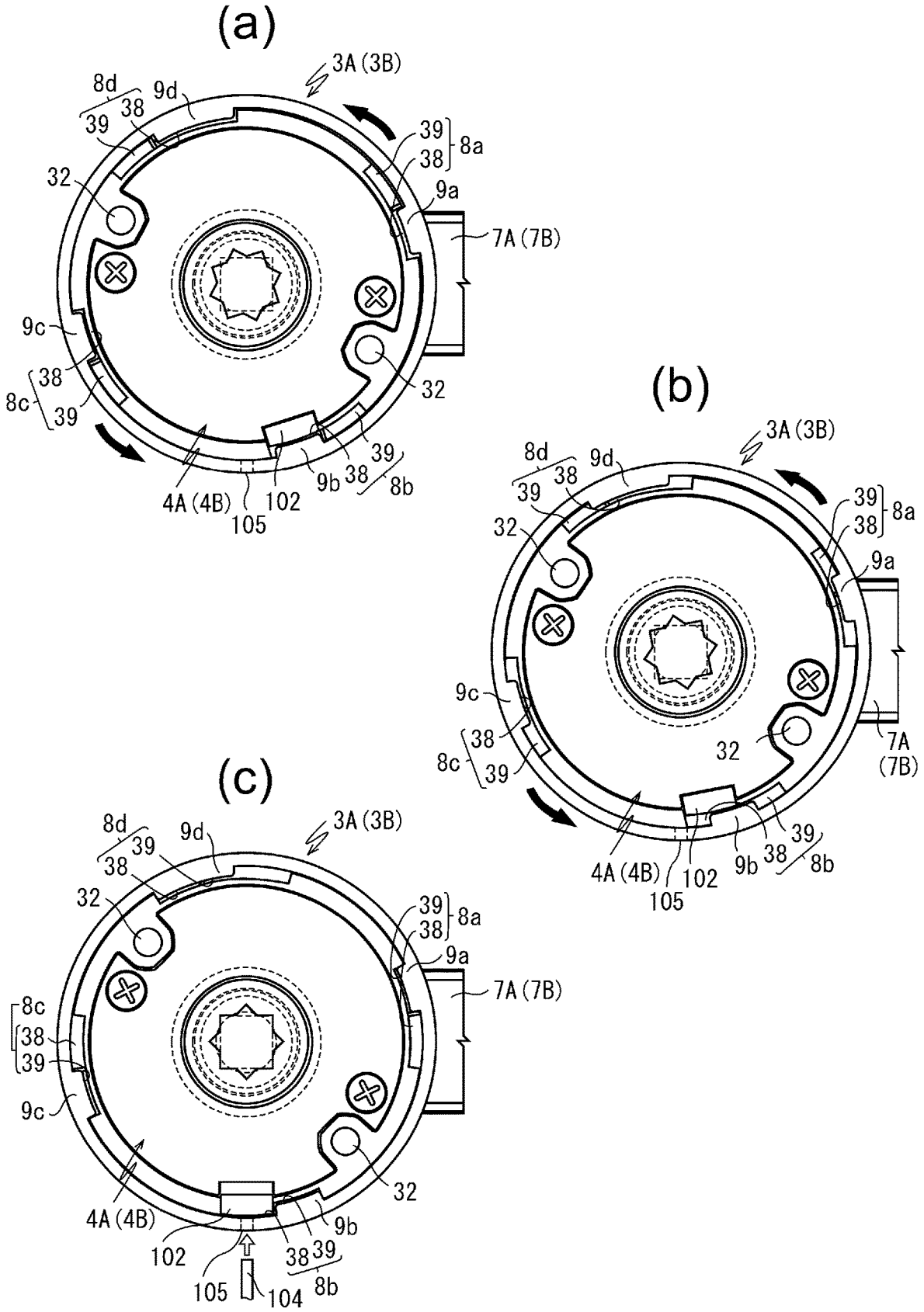
FIGS. 5(*a*), 5(*b*), and 5(*c*) are an explanatory view indicating a state of use of the embodiment illustrated in FIG. 1.

FIG. 5(*a*) illustrates a state in which the cover 4A(4B) is placed on the handle seat 3A(3B) arranged on the door 2 illustrated in FIG. 1. When the cover 4A(4B) is placed, each cover-side locking portion 9*a*, 9*b*, 9*c*, 9*d* formed on the cover 4A(4B) is inserted to the groove portion 38 of each handle seat-side locking portion 8*a*, 8*b*, 8*c*, 8*d* formed on the handle seat 3A(3B), the handle seat-side locking portions 8*a*, 8*b*, 8*c*, 8*d* being arranged in corresponding positions.

At this time, the engagement portion 102 formed at an end of the rotation prevention means 10 formed of a latch arranged in a position of the groove portion 38 of the handle seat-side locking portion 8*b* on a lower side of the handle seat 3A (3B) is pressed by the cover-side locking portion 9*b* of the cover 4A (4B) and is retracted to the bottom surface of the groove portion 38 such that the cover-side locking portion 9*b* is fit to the groove portion 38 without interference.

In particular, in the present embodiment, the square core member 6A(6B) and the handle 7A(7B) are preliminarily equipped on the cover 4A(4B). Therefore, simply when the cover 4A (4B) is placed and hooked on the handle seat 3A(3B), the square core member 6A(6B) is inserted to the hub 33 arranged on the handle seat 3A(3B) and the latch mechanism 1 set on the door 2 illustrated in FIG. 1, and furthermore there is no need of subsequent effort of fixedly securing the handle 7A(7B).

In the present embodiment, a lower end 103 of the engagement portion 102 formed at an end of the rotation prevention means 10 at an end surface on the inset side of the cover 4A(4B) is formed in a chamfered shape. Therefore, simply when the cover 4A(4B) is placed on the handle seat 3A(3B), regarding the engagement portion 102 formed at an end of the rotation prevention means 10 protruding to the groove portion 38, regarding the cover-side locking portion 9*b*, the engagement portion 102 of the rotation prevention means 10 protruding to the bottom surface of the groove portion 38 is naturally pressed in a direction of the proximal end along the chamber and is brought into state of being retracted from the groove portion 38, and the cover-side locking portion 9*b* is fit to the groove portion 38. For prevention, the engagement portion 102 is preliminarily pressed by a finger or a tool so as to be brought into a state of being retracted from the groove portion 38, and the cover-side locking portion 9*b* is inserted to the groove portion 38.

Then, as illustrated in FIG. 5(*b*), when the cover 4A(4B) placed on the handle seat 3A(3B) is rotated in a locking direction, each cover-side locking portion 9*a*, 9*b*, 9*c*, 9*d* is shifted to a hooking groove portion 39, which is contiguous to the groove portion 38, from the groove portion 38 forming each handle seat-side locking portion 8*a*, 8*b*, 8*c*, 8*d*, and when further rotated, as illustrated in FIG. 5(*c*), each cover-side locking portion 9*a*, 9*b*, 9*c*, 9*d* is inserted to the hooking groove portion 39 such that the locking means formed of the cover-side locking portions 9*a*, 9*b*, 9*c*, 9*d* and the handle seat-side locking portions 8*a*, 8*b*, 8*c*, 8*d* is brought into a hooked state. In particular, the cover-side locking portion 9*b* is shifted to the hooking groove portion 39 and releases the groove portion 38. Therefore, the engagement portion 102 of the rotation preventive means retracted into the groove portion 38 by the cover-side locking portion 9*b* is protruded to the groove portion 38, and contacts the cover-side locking portion 9*b* shifted to the hooking groove portion 39 to prevent rotation of the cover 4A(4B). Therefore, the cover 3A(3B) placed on the handle seat 4A(4B) will not be removed.

In addition, in the present embodiment, in a position where an inner surface of an outer circumference of the cover 4A (4B) contacts the engagement portion 102 of the rotation prevention means 10, an inset hole 105 for a tool 104 having a small rod shape for retracting the engagement portion 102 into the handle seat (4B) is formed.

Therefore, for cancellation between the respective cover-side locking portions 9*a*, 9*b*, 9*c*, 9*d* and the respective handle seat-side locking portions 8*a*, 8*b*, 8*c*, 8*d*, an end of the tool 104 inset into the inset hole 105 presses the engagement portion 102 of the rotation prevention means 10 against the biasing force of the coil spring 101 in a direction of the bottom surface of the groove portion 38 such that the contact state of the engagement portion 102 with respect to the cover-side locking portion 9*b* is canceled to allow for rotation of the cover 4A(4B) in an anti-hooking direction. The cover 4A(4B) can very easily be removed when removed in a state where the respective cover-side locking portions 9*a*, 9*b*, 9*c*, 9*d* are inserted to the groove portions 38 of the corresponding respective handle seat-side locking portions 8*a*, 8*b*, 8*c*, 8*d* as illustrated in FIG. 5(*a*). Therefore, repair or replacement of components or the like also can be made very easily.

In particular, in the present embodiment, the respective cover-side locking portions 9*a*, 9*b*, 9*c*, 9*d* having a protruding shape in which the end surface inwardly protruding on four points—upper and lower and right and left—orthogonal to each other at predetermined intervals in the circumference direction at the opening end edge 41 of the cover 4A(4B) and having an arc with a predetermined width are arranged at constant intervals. However, for example, only the cover-side locking portion 9*d* is formed long, and only the handle seat-side locking portion 8*d* of the handle seat-side locking portions 8*a*, 8*b*, 8*c*, 8*d* formed opposite the cover-side locking portion 9*d* is also formed long corresponding to the cover-side locking portion 9*d*. The locking position in the rotation direction of the cover 4A(4B) is restricted. Therefore, in the present embodiment, the rotation prevention means 10 is invariably arranged on a lower side. The inset hole 105 for the tool 104 having a small rod shape for retracting the engagement portion 102 formed on the cover 4A(4B) into the handle seat (4B) is positioned at a lower hidden part such that there is no need to worry about impairment of aesthetic appearance.

In the present embodiment, the respective cover-side locking portions 9*a*, 9*b*, 9*c*, 9*d* and the respective handle seat-side locking portions 8*a*, 8*b*, 8*c*, 8*d* may be arranged at uniform intervals such that a uniform, stable locked state can be formed over the entire circumference. However, the respective cover-side locking portions 9*a*, 9*b*, 9*c*, 9*d* and the respective handle seat-side locking portions 8*a*, 8*b*, 8*c*, 8*d*, which are locked to each other, may be mutually positioned not at uniform intervals (not illustrated).

As described heretofore, according to the present embodiment, not only mounting can be made easily and quickly, but also removal can be made easily. There is no need to worry about deformation of or damage to the cover 4A(4B) during attachment and detachment.

In the present embodiment, the hub 12 is divided in the hub casing 13 into two: the hub member 12A on the indoor side to which the square core member 6A on the indoor side is inserted and the hub member 12B on the outdoor side to which the square core member 6B on the outdoor side is inserted. Furthermore, the hub member 12B on the outdoor side is fixed to the hub casing 13. Thus, the operation of the handle 7B from the outdoor side is restricted. However, when the hub member 12B is configured to have the same structure as the hub member 12A on the indoor side, a configuration enabling locking and unlocking from indoor and outdoor sides can be made so as to be used for various purposes.

In addition, in the present embodiment, the cover 4A(4B) preliminarily including the handle 7A(7B) is indicated. However, needless to say, the present embodiment may be carried out similarly with respect to a different type of handle seat including the conventional handle seat in which handles are fixedly secured to both ends of a square core subsequently inserted into the conventional handle seat.

REFERENCE SIGNS LIST

1 latch mechanism
2 door
3A handle seat
3B handle seat
4A cover
4B cover
6 square core
6A square core member
6B square core member
7A handle
7B handle
8*a*, 8*b*, 8*c*, 8*d* handle seat-side locking portion
9*a*, 9*b*, 9*c*, 9*d* cover-side locking portion
10 rotation prevention means
11 latch bolt
12 hub
12A hub member
12B hub member
13 hub casing
21 edge
22 attachment groove
23 inner side surface
24 outer side surface
31 handle seat main body
32 through-hole
33 hub
34 return spring
35 outer circumferential surface
36 front surface
37 rear surface
38 groove portion
39 hooking groove portion
40 lid plate
41 opening end edge
42 through-hole
43 retainer ring
51 bolt
52 threaded cylinder
71 shaft member
72 square hole
73 coil spring
101 coil spring
102 engagement portion
103 lower end
104 tool
105 inset hole
331 hub casing
d axis

The invention claimed is:

1. A locking structure for a cover covering a disk-shaped handle seat, the cover being placed to cover a front surface and a circumferential surface of the handle seat mounted opposite an inner side surface and an outer side surface of a door for supporting a square core equipped with a handle for actuating a latch mechanism arranged within the door, the locking structure comprising:

a cover locking mechanism including a plurality of protrusion-shaped cover-side locking portions protruding inward at circumferential intervals at an opening end edge of the cover, and a plurality of handle seat-side locking portions, each formed of a groove portion extending from a front surface to a rear surface, and through which each of the cover-side locking portions formed on the cover can be inserted when the cover is placed over the handle seat, and a hooking groove portion formed continuously and transversely to the groove portion in a rotation direction of the cover when the cover is placed over the handle seat, to which the cover is moved into a hooked state when the cover-side locking portions formed on the cover are inserted when the cover placed is rotated; and a rotation prevention mechanism including a latch arranged to be movable back and forth and biased in a direction of an end along an axis from a center to an outer circumferential surface of the handle seat at a position of one of the groove portions forming the handle seat-side locking portion and having, at an end, an engagement portion projecting and retracting with respect to a bottom surface of the groove portion such that, when the cover is placed over the handle seat, the cover-side locking portion will enter the groove portion, engaging the engagement portion of the latch so as to retract the engagement portion, allowing further insertion of the cover-side locking portion so as to arrive at the hooked state, the engagement portion is biased back to the groove portion and contacts the cover-side locking portion erected on the cover preventing withdrawal of the cover from the handle seat.

2. The locking structure according to claim 1, wherein, in a position where an inner surface of a body portion of the cover contacts the engagement portion of the rotation prevention mechanism, an inset hole for a tool for retracting the engagement portion into the handle seat is formed.

3. The locking structure according to claim 1, wherein the rotation prevention mechanism arranged on the handle seat is arranged at a lower position.

4. The locking structure according to claim 2, wherein the rotation prevention mechanism arranged on the handle seat is arranged at a lower position.

* * * * *